US011255126B1

(12) United States Patent
Adams

(10) Patent No.: US 11,255,126 B1
(45) Date of Patent: Feb. 22, 2022

(54) LADDER TRAY ASSEMBLY

(71) Applicant: Cecil Adams, Reading, MI (US)

(72) Inventor: Cecil Adams, Reading, MI (US)

( * ) Notice: Subject to any disclaimer, the term of this patent is extended or adjusted under 35 U.S.C. 154(b) by 0 days.

(21) Appl. No.: 17/124,179

(22) Filed: Dec. 16, 2020

(51) Int. Cl.

| | |
|---|---|
| ***E06C 7/14*** | (2006.01) |
| ***E06C 7/16*** | (2006.01) |
| ***B44D 3/12*** | (2006.01) |
| ***B44D 3/14*** | (2006.01) |
| *E06C 1/39* | (2006.01) |

(52) U.S. Cl.
CPC ..... *E06C 7/143* (2013.01); *B44D 3/125* (2013.01); *B44D 3/14* (2013.01); *E06C 7/16* (2013.01); *E06C 7/165* (2013.01); *E06C 1/39* (2013.01)

(58) Field of Classification Search
CPC . E06C 1/393; E06C 5/32; E06C 7/165; E06C 7/14; E06C 7/143; B66D 3/14; B44D 3/125
See application file for complete search history.

(56) References Cited

U.S. PATENT DOCUMENTS 2,911,133 A * 11/1959 Ruggieri ..... E06C 7/14 182/129
2,982,982 A * 5/1961 Swift, Sr. ..... E06C 7/14 15/257.06
3,154,282 A * 10/1964 Monson ..... E06C 7/14 248/211
3,422,923 A * 1/1969 Lund ..... E06C 7/14 182/120
3,495,683 A * 2/1970 Broden ..... E06C 7/14 182/116
3,792,750 A * 2/1974 Madison ..... E06C 7/48 182/206
3,822,846 A * 7/1974 Jesionowski ..... E06C 7/143 248/210
3,822,847 A * 7/1974 Emmons ..... E06C 7/14 248/210
4,013,251 A 3/1977 Cleveland
4,318,523 A * 3/1982 Weatherly ..... E06C 7/143 182/116
4,437,544 A * 3/1984 Anderson ..... E06C 7/165 182/120
4,489,911 A * 12/1984 Riley ..... E06C 7/143 182/121

(Continued)

FOREIGN PATENT DOCUMENTS

CA 2354696 A1 * 2/2002 ..... E06C 1/387
FR 2499145 A1 * 8/1982 ..... E06C 7/143

(Continued)

*Primary Examiner* — Jonathan Liu
*Assistant Examiner* — Taylor L Morris

(57) ABSTRACT

A ladder tray assembly includes a case that has a recess integrated therein. A lid is hingedly coupled to the case for opening and closing the case. A pole is extendable through the case and the pole is inserted into a rung of a ladder thereby mounting the case to the ladder. A case member is coupled to and extends away from the case and a grip is coupled to the case member. The grip extends around the pole when the pole is extended through the case and the grip extends around the rung through which the pole is extended. A pair of storage units is each attachable to the lid when the lid is in an open position to facilitate tools stored in the storage units to be accessible to a user.

14 Claims, 5 Drawing Sheets

(56) References Cited

U.S. PATENT DOCUMENTS 4,515,242 A * 5/1985 LaChance ..... E06C 7/14 182/106
4,646,878 A * 3/1987 Moyer ..... E06C 7/16 182/121
4,662,594 A * 5/1987 Dubis ..... E06C 7/143 248/231.21
4,874,147 A * 10/1989 Ory ..... E06C 7/14 248/210
4,979,710 A * 12/1990 Baldwin ..... E06C 7/14 248/210
4,998,696 A * 3/1991 Desjardins ..... B44D 3/12 220/737
5,031,723 A * 7/1991 Hooten ..... E06C 1/38 182/129
5,120,013 A * 6/1992 Sweeney ..... E06C 7/14 182/116
5,135,193 A * 8/1992 Parris ..... E06C 7/143 182/129
5,158,023 A * 10/1992 Allen ..... E04G 5/00 108/42
5,191,954 A * 3/1993 Ledford ..... E06C 7/143 182/121
5,259,525 A * 11/1993 Wion ..... E06C 7/143 220/737
5,413,296 A * 5/1995 LaFontaine ..... B44D 3/123 248/210
5,582,269 A * 12/1996 Gugel ..... B25H 3/02 182/129
5,622,278 A * 4/1997 Fries ..... E06C 7/14 206/373
5,624,093 A * 4/1997 Gemmell ..... B44D 3/125 220/570
5,687,941 A * 11/1997 Quintile ..... E06C 7/14 248/210
5,740,883 A * 4/1998 Trank ..... E06C 7/14 182/129
5,913,380 A * 6/1999 Gugel ..... E06C 7/182 182/129
5,960,905 A * 10/1999 Gardner ..... E06C 7/143 182/129
5,971,103 A * 10/1999 Mulvaney ..... E06C 7/143 182/129
6,029,776 A * 2/2000 Brown ..... E06C 7/14 182/129
6,158,551 A * 12/2000 Gray ..... E06C 7/14 182/107
6,241,204 B1 * 6/2001 Bermes ..... B44D 3/14 182/129
6,244,383 B1 * 6/2001 Jung ..... E06C 7/16 182/107
6,273,289 B1 8/2001 Bowman
6,352,135 B1 3/2002 Jones
6,431,509 B1 * 8/2002 Proulx ..... E06C 7/14 182/121
6,766,990 B1 * 7/2004 Hileman ..... E06C 7/143 182/129
7,032,711 B1 * 4/2006 Katz ..... B25H 3/06 182/129
7,156,205 B2 * 1/2007 Wilson ..... E06C 1/39 182/129
7,264,084 B1 * 9/2007 Switzer ..... E06C 7/14 182/129
8,033,362 B1 10/2011 Cull
8,123,000 B2 2/2012 Whitaker
8,251,180 B1 * 8/2012 Paige ..... E06C 7/48 182/107
8,469,148 B2 6/2013 Perry
8,807,281 B1 * 8/2014 Hoffman ..... E06C 7/143 182/129
9,045,940 B2 * 6/2015 Walters ..... E06C 7/143
9,353,571 B2 * 5/2016 Coe ..... E06C 7/14
10,119,332 B1 * 11/2018 Schellens ..... B44D 3/14
10,358,832 B1 * 7/2019 Wagner ..... E06C 7/165
10,501,989 B1 * 12/2019 McDonough ..... E06C 7/14
10,718,120 B1 * 7/2020 Haney ..... E04G 5/003
2004/0163890 A1 * 8/2004 Nash, Jr. ..... E06C 7/16 182/122
2007/0181761 A1 * 8/2007 Astor ..... E06C 7/14 248/238
2007/0221802 A1 9/2007 New, Sr.
2007/0228237 A1 10/2007 Pchurek
2008/0061201 A1 * 3/2008 Sasser ..... E06C 7/14 248/210
2009/0308996 A1 * 12/2009 Hohensee ..... E06C 7/143 248/238
2012/0187266 A1 * 7/2012 Schirmacher ..... E06C 7/14 248/238
2015/0108302 A1 * 4/2015 Kahn ..... F16M 13/022 248/210
2016/0010391 A1 * 1/2016 Otten ..... E06C 1/39 248/238
2016/0153235 A1 * 6/2016 Villar ..... E06C 7/14 220/475
2018/0023345 A1 * 1/2018 Andrade ..... A47B 13/083 108/25
2018/0094487 A1 * 4/2018 Ellis ..... E06C 7/16
2019/0023062 A1 * 1/2019 Hamilton ..... B44D 3/12
2020/0254605 A1 * 8/2020 McGee ..... B25H 3/06

FOREIGN PATENT DOCUMENTS

WO WO-9909289 A2 * 2/1999 ..... E06C 7/182
WO 2008045152 4/2008

* cited by examiner

LADDER TRAY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tray devices and more particularly pertains to a new tray devices for storing painting tools on a ladder.

(2) Description of Related Art Including Information Disclosed Under 37 CFR 1.97 and 1.98

The prior art relates to tray devices including a variety of ladder storage devices that have at least one hook with lies on top of a rung on a ladder for storing tools on the ladder. The prior art discloses a ladders storage device that includes an insert which is positionable in a rung of a ladder and the tray to which a rod is attached that is extendable through the insert in the rung. The prior art discloses a ladder storage device that includes a rod that is insertable through a rung of a ladder and a tray that is suspended from the rod for storing tools. The prior art also discloses a ladder storage device that includes a rod that is insertable into a rung of a ladder, a tray that is attached to the ladder to storing tools and a pair of supports that each engage a leg of the ladder for supporting the tray.

BRIEF SUMMARY OF THE INVENTION

An embodiment of the disclosure meets the needs presented above by generally comprising a case that has a recess integrated therein. A lid is hingedly coupled to the case for opening and closing the case. A pole is extendable through the case and the pole is inserted into a rung of a ladder thereby mounting the case to the ladder. A case member is coupled to and extends away from the case and a grip is coupled to the case member. The grip extends around the pole when the pole is extended through the case and the grip extends around the rung through which the pole is extended. A pair of storage units is each attachable to the lid when the lid is in an open position to facilitate tools stored in the storage units to be accessible to a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
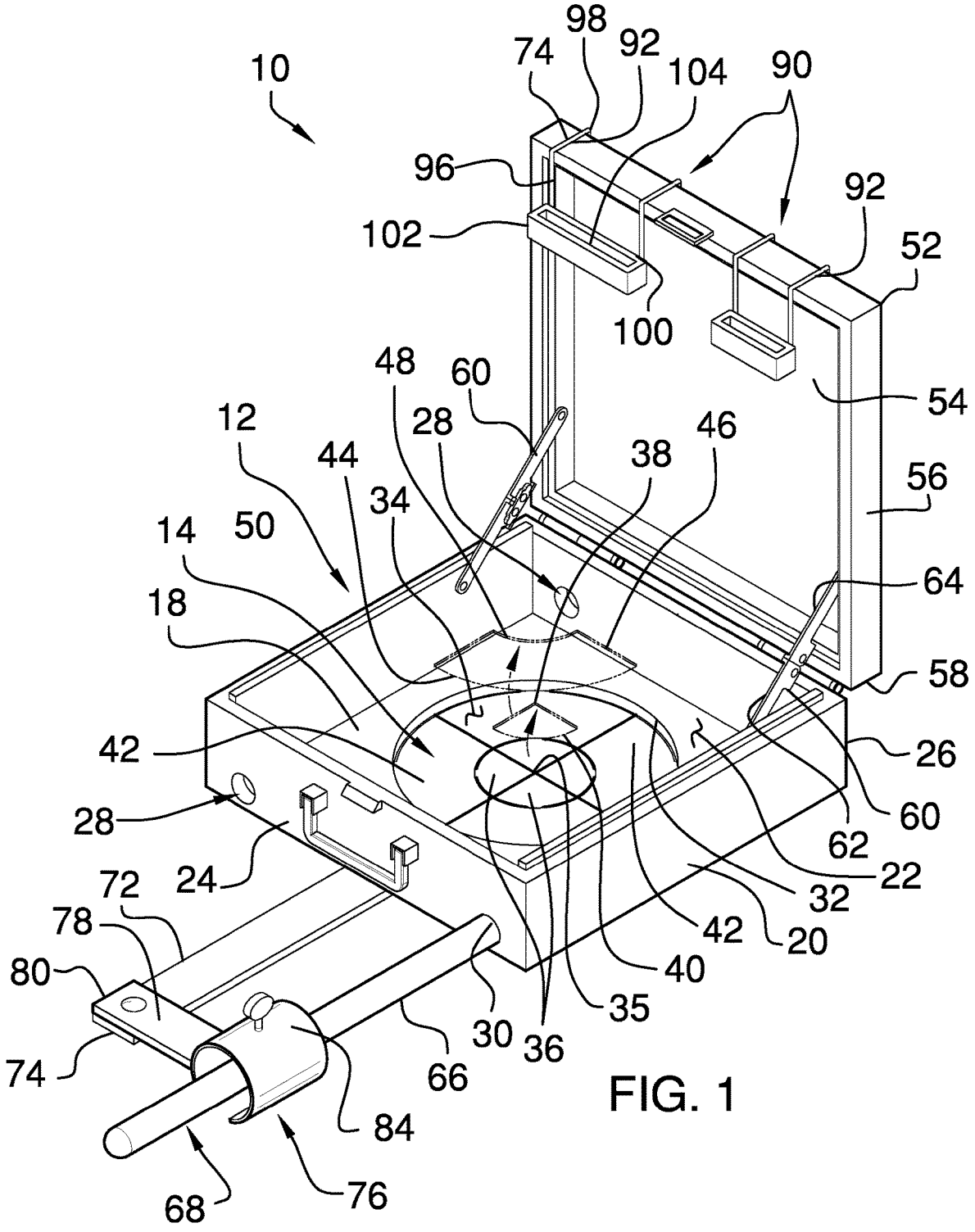
FIG. 1 is a perspective view of a ladder tray assembly according to an embodiment of the disclosure.
Figure 2:
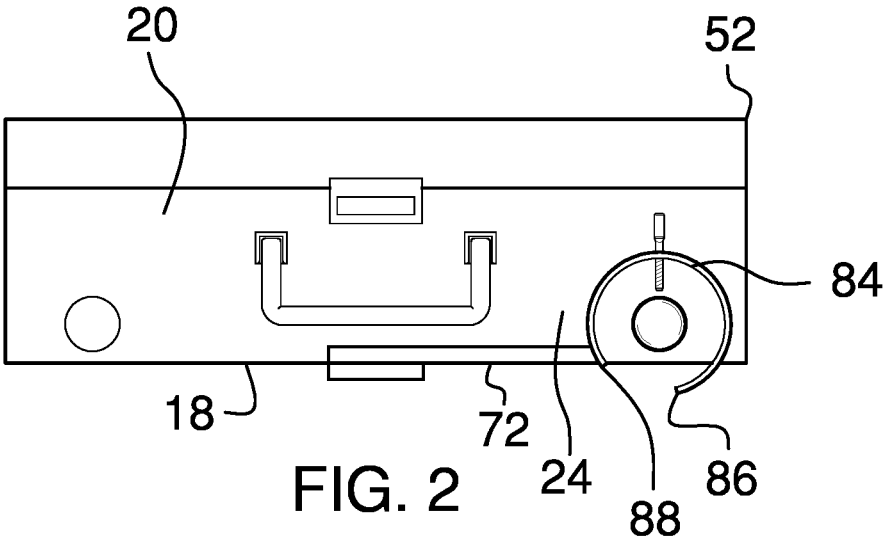
FIG. 2 is a front view of an embodiment of the disclosure.
Figure 3:
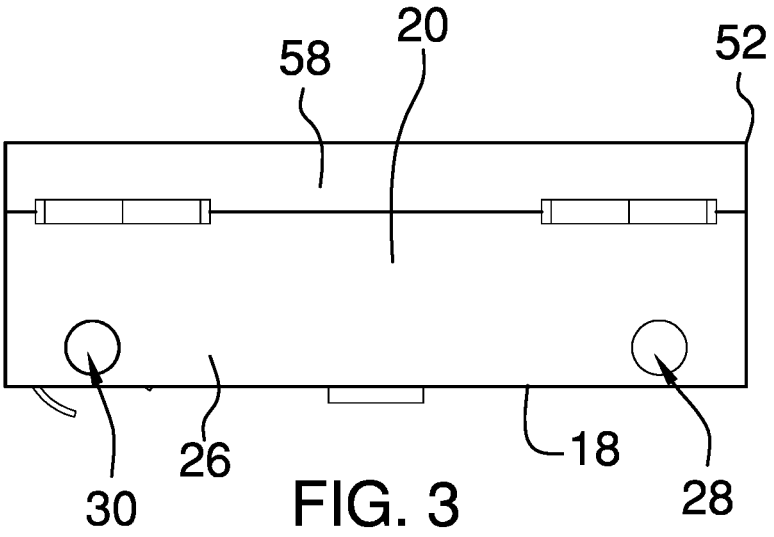
FIG. 3 is a back view of an embodiment of the disclosure.
Figure 4:
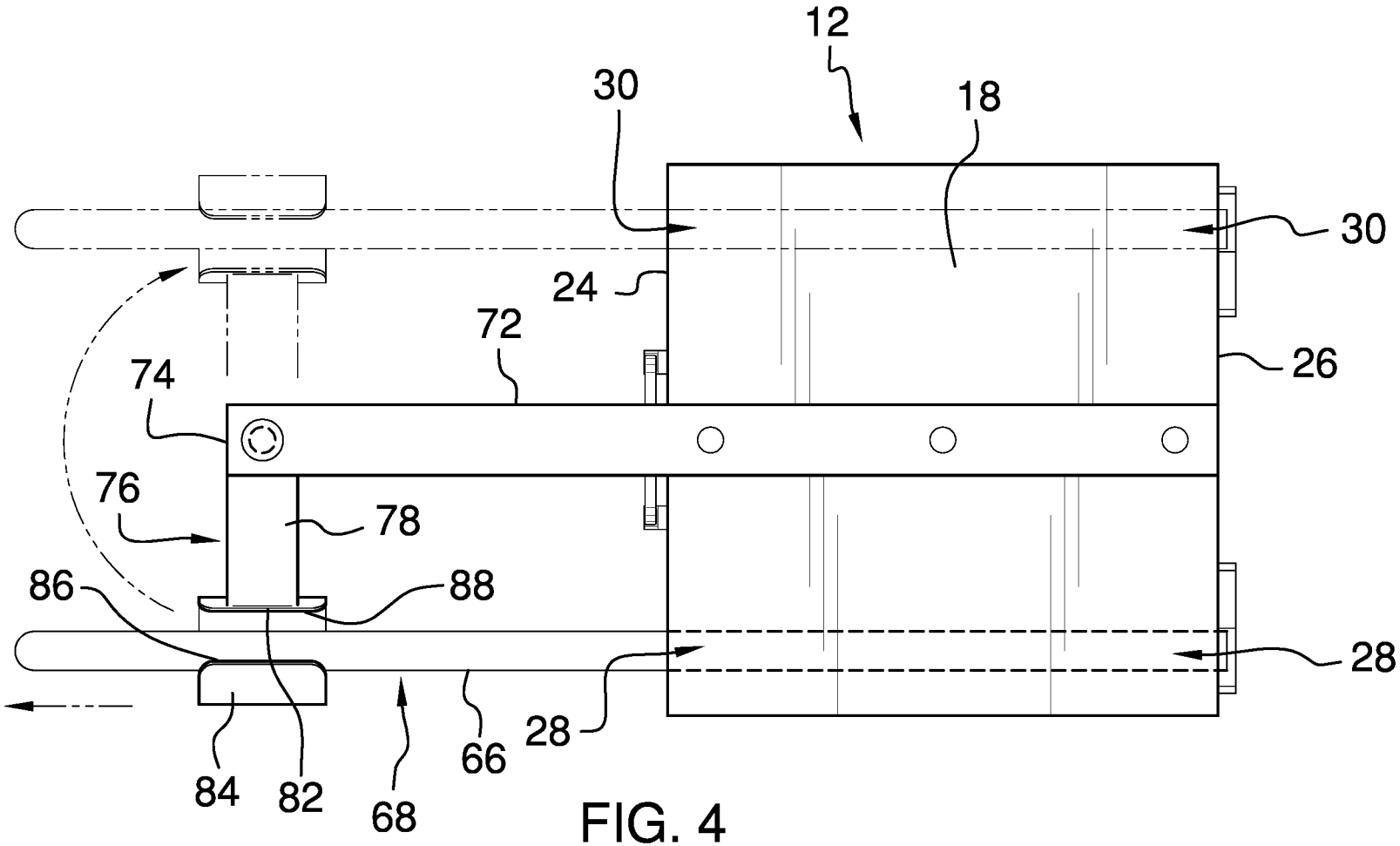
FIG. 4 is a bottom view of an embodiment of the disclosure.
Figure 5:
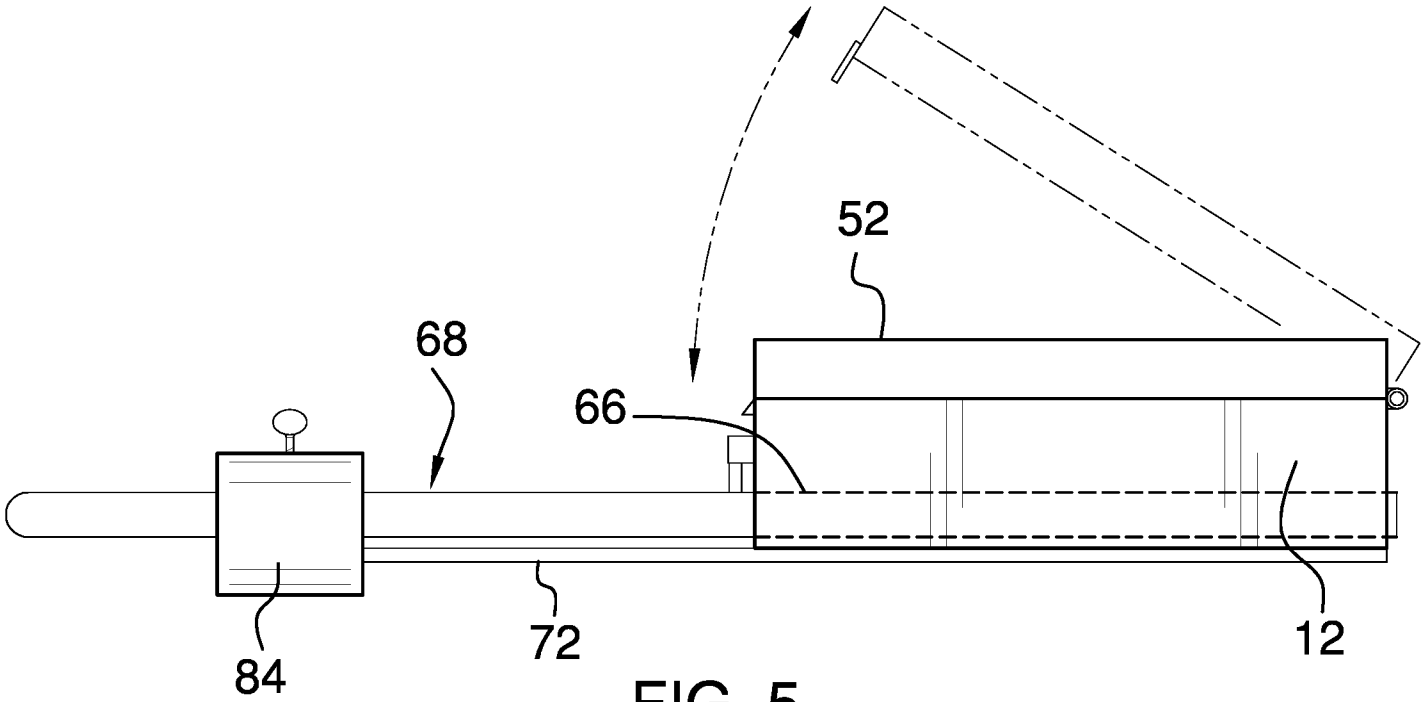
FIG. 5 is a left side view of an embodiment of the disclosure.
Figure 6:
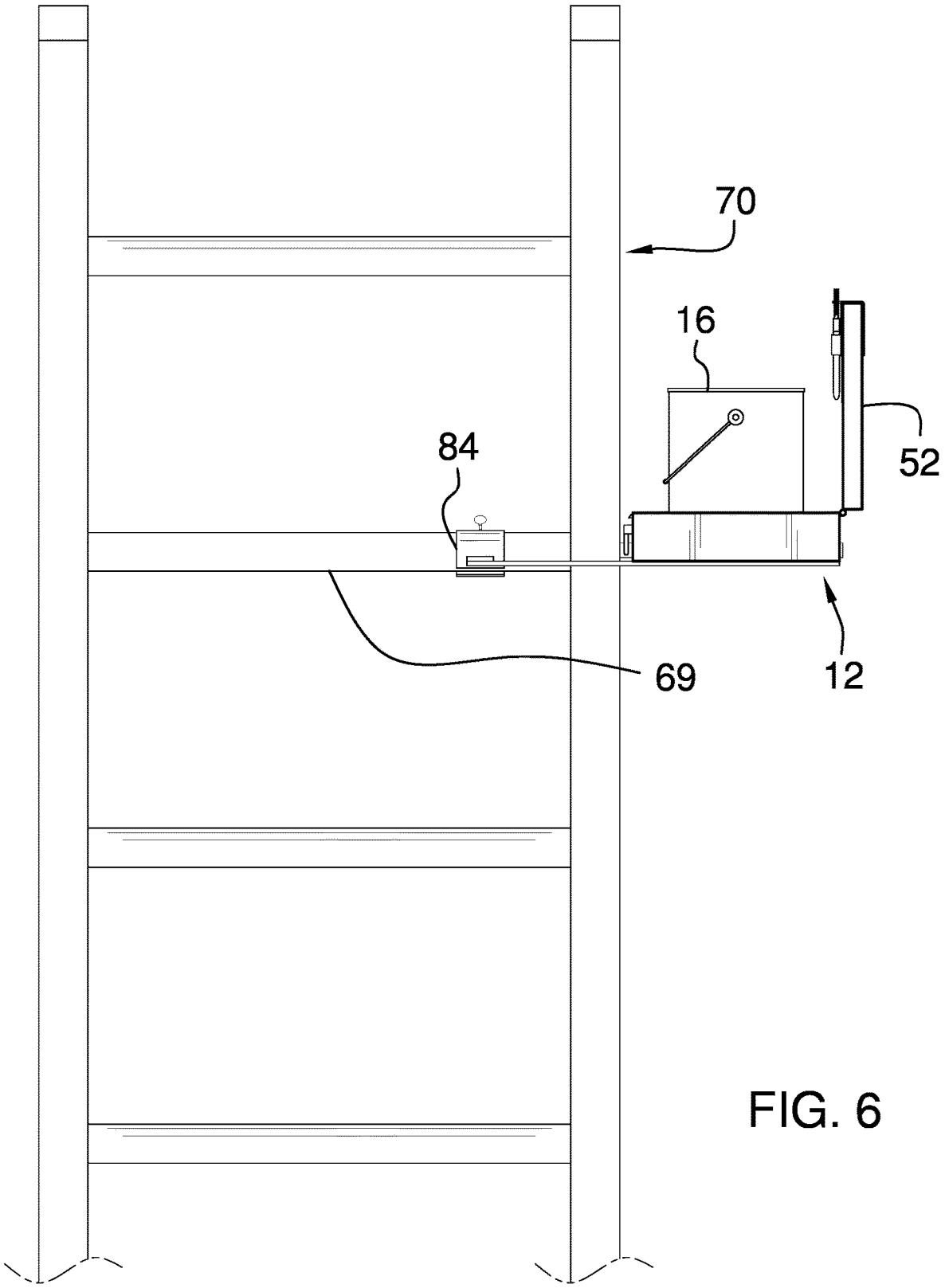
FIG. 6 is a perspective in-use view of an embodiment of the disclosure.

With reference now to the drawings, and in particular to FIGS. 1 through 6 thereof, a new tray device embodying the principles and concepts of an embodiment of the disclosure and generally designated by the reference numeral 10 will be described.

As best illustrated in FIGS. 1 through 6, the ladder tray assembly 10 generally comprises a case 12 that has a recess 14 integrated therein to accommodate a paint can 16. The case 12 has a bottom wall 18 and an outer wall 20 extending upwardly therefrom, and the bottom wall 18 has a top surface 22, and the outer wall 20 has a front side 24 and a back side 26. Each of the front side 24 and the back side 26 has a respective one of a pair of first openings 28 each extending therethrough, and the first openings 28 are aligned with each other. Each of the front side 24 and the back side 26 has a respective one of a pair of second openings 30 each extending therethrough and each of the second openings 30 is aligned with each other.

The recess 14 extends downwardly into the top surface 22 of the bottom wall 18, and the recess 14 has a bounding edge 32 and a bounding surface 34. The bounding edge 32 is continuously arcuate about a center point 35 of the bounding surface 34 such that the recess 14 has a circular shape. A plurality of wedges 36 is each pivotally coupled to the top surface 22 of the bottom wall 18 of the case 12. The plurality of wedges 36 has a pointed end 38 and a curved end 40 and the curved end 40 of each of the wedges 36 is pivotally coupled to the bounding surface 34 of the recess 14. The pointed end 38 of each of the wedges 36 is aligned with the center point 35 of the bounding surface 34 such that the wedges 36 form a circle when the wedges 36 lie on the bounding surface 34. Each of the wedges 36 is positionable in an upright position having each of the wedges 36 extending upwardly from the bounding surface 34 where to restrain a paint can 16 of a small diameter.

A plurality of panels 42 is provided and each of the panels 42 has a first end 44, a second end 46, a front edge 48 and a back edge 50. Each of the front edge 48 and the back edge 50 is curved between the first end 44 and the second end 46 such that each of the panels 42 forms a quadrant of a circle. The back edge 50 of each of the panels 42 is pivotally coupled to the bounding surface 34 and each of the panels 42 forms a ring encircling the plurality of wedges 36 when the panels 42 lie on the bounding surface 34. Each of the panels 42 is positionable in an upright position having each of the panels 42 extending upwardly from the bounding surface 34. In this way the plurality of panels 42 can restrain a paint can 16 of a large diameter.

A lid 52 is hingedly coupled to the case 12 for opening and closing the case 12. The lid 52 has a top wall 54 and a perimeter wall 56 extending downwardly therefrom, and the perimeter wall 56 has a rear side 58. The rear side 58 is hingedly coupled to the back side 26 of the outer wall 20 of the case 12 and the perimeter wall 56 rests on the outer wall 20 when the lid 52 is closed. A pair of supports 60 is provided and each of the supports 60 comprises a first portion 62 is pivotally coupled to a second portion 64. The first portion 62 of each of the supports 60 is movably coupled to the outer wall 20 of the case 12 and the second portion 64 of each of the supports 60 is movably coupled to the perimeter wall 56 of the lid 52. Additionally, each of the supports 60 is biased into an extended position when the lid 52 is positioned in the open position for releasably retaining the lid 52 in the open position.

A pole 66 is provided and the pole 66 is extendable through the case 12. The pole 66 has an exposed portion 68 when the pole 66 is extended through the case 12. Additionally, the exposed portion 68 can be inserted into a rung 69 of a ladder 70 thereby mounting the case 12 to the ladder 70. The ladder 70 may be an aluminum extension ladder 70 or other type of ladder 70 that has holes in each of the legs of the ladder 70 that are aligned with each of the rungs 69 on the ladder 70. The pole 66 is insertable through each of the first openings 28 in the outer wall 20 of the case 12 or each of the second openings 30 in the outer wall 20 of the case 12. Additionally, the exposed portion 68 of the pole 66 extends away from the front side 24 of the outer wall 20 of the case 12.

A case member 72 is provided and the case member 72 is coupled to and extends away from the case 12. The case member 72 is attached to the bottom wall 18 of the case 12 and the case member 72 extends away from front side 24 of the outer wall 20. Additionally, the case member 72 has a distal end 74 with respect to the front side 24. A grip 76 is coupled to the case member 72 and the grip 76 extends around the pole 66 when the pole 66 is extended through the case 12. In this way the grip 76 can be extended around the rung 69 through which the pole 66 is extended.

The grip 76 comprises a grip member 78 that has a first end 80 and a second end 82. The first end 80 is pivotally coupled to the case member 72 at a point that is located adjacent to the distal end 74 of the case member 72. The grip member 78 has a pivotal axis that is oriented perpendicular to a longitudinal axis of the case member 72. Thus, the grip 76 is rotatable to point toward either the first opening 28 or the second opening 30 in the front side 24 of the outer wall 20 of the case 12. A collar 84 is provided that has a primary end 86 and a secondary end 88. The collar 84 is curved such that the primary end 86 is spaced from the secondary end 88. The secondary end 88 is coupled to the second end 46 of the grip member 78 such that the collar 84 extends around the rung 69 through which the pole 66 is extended thereby stabilizing the case 12 on the rung 69. A thumb screw 49 is integrated in the collar 84 and the thumb screw 49 can be loosened or tightened. The thumb screw 49 engages the rung 69 when the thumb screw 49 is tightened and the collar 84 is positioned around the rung 69 to inhibit the collar 84 from slipping on the rung 69.

A pair of storage units 90 is included and each of the storage units 90 is attachable to the lid 52 when the lid 52 is in an open position. Each of the storage units 90 facilitates tools stored in the storage units 90 to be accessible to a user. Each of the storage units 90 comprises a bracket 92 has a central portion 94 that extends between a first portion 96 and a second portion 98 such that the bracket 92 has a "U" shape. The bracket 92 is positionable over the lid 52 when the lid 52 is in an open position has the central portion 94 resting on perimeter wall 56 of the lid 52 and having each of the first portion 96 and the second portion 98 extending toward the case 12. Additionally, the first portion 96 has a distal end 100 with respect to the central portion 94.

A box 102 is coupled to the distal end 100 of the first portion 96 of the bracket 92 such that the box 68 is suspended on the lid 52 when the bracket 92 is positioned on the lid 52. The box 102 has a top end 104 that is open and is directed upwardly when the bracket 92 is positioned on the lid 52. In this way the box 102 can store tools. The tools may be paint brushes or other tools commonly employed in painting.

In use, the lid 52 is positioned in the open position and the pole 66 is extended through each through either the pair first openings 28 or the pair of second openings 30 depending on whether the case 12 will be positioned on the left side or the right side of the ladder 70. The exposed portion 68 of the pole 66 is inserted into a respective rung 69 on the ladder 70 thereby mounting the case 12 on the ladder 70. Additionally, the collar 84 is positioned to extend around the rung 69 through which the pole 66 extends. Each of the wedges 36 can be positioned in the upright position to restraining a small paint can 16 or each of the panels 42 can be positioned in the upright position for restraining a large paint can 16. Additionally, each of the storage units 90 can be positioned on the lid 52 for storing painting tools. In this way the paint can 16 and the painting tools can be stored on either the left side or the right side of the ladder 70.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ladder tray assembly for storing a paint can and painting tools on a ladder, said assembly comprising:

a case having a recess being integrated therein wherein said recess is configured to accommodate a paint can;

a lid being hingedly coupled to said case for opening and closing said case;

a pole being extendable through said case, said pole having an exposed portion when said pole is extended through said case wherein said exposed portion is configured to be inserted into a rung of a ladder thereby mounting said case to the ladder;

a case member being coupled to and extending away from said case;

a grip being coupled to said case member, said grip extending around said pole when said pole is extended through said case wherein said grip is configured to extend around the rung through which said pole is extended; and;

a pair of storage units, each of said storage units being attachable to said lid when said lid is in an open position wherein each of said storage units is configured to facilitate tools stored in said storage units to be accessible to a user;

said case having a bottom wall and an outer wall extending upwardly therefrom, said bottom wall having a top surface, said outer wall having a front side and a back side;

each of said front side and said back side having a respective one of a pair of first openings each extending therethrough, said first openings being aligned with each other; and each of said front side and said back side having a respective one of a pair of second openings each extending therethrough, each of said second openings being aligned with each other; and wherein said pole is insertable through each of said first openings in said outer wall of said case or each of said second openings in said outer wall of said case, said exposed portion of said pole extending away from said front side of said outer wall of said case.

2. The assembly according to claim 1, wherein said recess extends downwardly into said top surface of said bottom wall, said recess having a bounding edge and a bounding surface, said bounding edge being continuously arcuate about a center point of said bounding surface such that said recess has a circular shape.

3. The assembly according to claim 1, wherein said lid has a top wall and a perimeter wall extending downwardly therefrom, said perimeter wall having a rear side, said rear side being hingedly coupled to said back side of said outer wall of said case, said perimeter wall resting on said outer wall when said lid is closed.

4. The assembly according to claim 3, further comprising a pair of supports, each of said supports comprising a first portion being pivotally coupled to a second portion, said first portion of each of said supports being movably coupled to said outer wall of said case, said second portion of each of said supports being movably coupled to said perimeter wall of said lid, each of said supports being biased into an extended position when said lid is positioned in said open position for releasably retaining said lid in said open position.

5. The assembly according to claim 3, wherein each of said storage units comprises a bracket having a central portion extending between a first portion and a second portion such that said bracket has a "U" shape, said bracket being positionable over said lid when said lid is in an open position having said central portion resting on perimeter wall of said lid having each of said first portion and said second portion extending toward said case, said first portion having a distal end with respect to said central portion.

6. The assembly according to claim 5, wherein each of said storage units comprises a box being coupled to said distal end of said first portion such that said box is suspended on said lid when said bracket is positioned on said lid, said box having a top end being open and being directed upwardly when said bracket is positioned on said lid wherein said box is configured to store tools.

7. The assembly according to claim 1, wherein said case member is attached to said bottom wall of said case, said case member extending away from said front side of said outer wall, said case member having a distal end with respect to said front side.

8. The assembly according to claim 7, wherein said grip comprises a grip member having a first end and a second end, said first end being pivotally coupled to said case member at a point located adjacent to said distal end of said case member, said grip member being pivotal on an axis being oriented perpendicular to a longitudinal axis of said case member, said grip being rotatable to point toward either said first hole or said second hole in said front side of said outer wall of said case.

9. The assembly according to claim 8, wherein said grip comprises a collar having a primary end and a secondary end, said collar being curved such that said primary end is spaced from said secondary end, said secondary end being coupled to said second end of said grip member wherein said collar is configured to extend around the rung through which said pole is extended thereby stabilizing said case on the rung.

10. A ladder tray assembly for storing a paint can and painting tools on a ladder, said assembly comprising:

a case having a recess being integrated therein wherein said recess is configured to accommodate a paint can;

a lid being hingedly coupled to said case for opening and closing said case;

a pole being extendable through said case, said pole having an exposed portion when said pole is extended through said case wherein said exposed portion is configured to be inserted into a rung of a ladder thereby mounting said case to the ladder;

a case member being coupled to and extending away from said case;

a grip being coupled to said case member, said grip extending around said pole when said pole is extended through said case wherein said grip is configured to extend around the rung through which said pole is extended; and;

a pair of storage units, each of said storage units being attachable to said lid when said lid is in an open position wherein each of said storage units is configured to facilitate tools stored in said storage units to be accessible to a user;

said case having a bottom wall and an outer wall extending upwardly therefrom, said bottom wall having a top surface, said outer wall having a front side and a back side;

each of said front side and said back side having a respective one of a pair of first openings each extending therethrough, said first openings being aligned with each other;

each of said front side and said back side having a respective one of a pair of second openings each extending therethrough, each of said second openings being aligned with each other;

wherein said recess extends downwardly into said top surface of said bottom wall, said recess having a bounding edge and a bounding surface, said bounding edge being continuously arcuate about a center point of said bounding surface such that said recess has a circular shape; and a plurality of wedges, each of said wedges being pivotally coupled to said top surface of said bottom wall of said case, said plurality of wedges having a pointed end and a curved end, said curved end of each of said wedges being pivotally coupled to said bounding surface of said recess, said pointed end of each of said wedges is aligned with said center point of said bounding surface such that said wedges forms a circle when said wedges lie on said bounding surface.

11. The assembly according to claim 10, wherein each of said wedges is positionable in an upright position having each of said wedges extending upwardly from said bounding surface wherein said plurality of wedges is configured to restrain a paint can of a small diameter.

12. The assembly according to claim 10, further comprising a plurality of panels, each of said panels having a first end, a second end, a front edge and a back edge, each of said front edge and said back edge being curved between said first end and said second end such that each of said panels forms a quadrant of a circle, said back edge of each of said panels being pivotally coupled to said bounding surface, each of said panels forming a ring encircling said plurality of wedges when said panels lie on said bounding surface.

13. The assembly according to claim 12, wherein each of said panels is positionable in an upright position having each of said panels extending upwardly from said bounding surface wherein said plurality of panels is configured to restrain a paint can of a large diameter.

14. A ladder tray assembly for storing a paint can and painting tools on a ladder, said assembly comprising:

a case having a recess being integrated therein wherein said recess is configured to accommodate a paint can, said case having a bottom wall and an outer wall extending upwardly therefrom, said bottom wall having a top surface, said outer wall having a front side and a back side, each of said front side and said back side having a respective one of a pair of first openings each extending therethrough, said first openings being aligned with each other, each of said front side and said back side having a respective one of a pair of second openings each extending therethrough, each of said second openings being aligned with each other, said recess extending downwardly into said top surface of said bottom wall, said recess having a bounding edge and a bounding surface, said bounding edge being continuously arcuate about a center point of said bounding surface such that said recess has a circular shape;

a plurality of wedges, each of said wedges being pivotally coupled to said top surface of said bottom wall of said case, said plurality of wedges having a pointed end and a curved end, said curved end of each of said wedges being pivotally coupled to said bounding surface of said recess, said pointed end of each of said wedges being aligned with said center point of said bounding surface such that said wedges forms a circle when said wedges lie on said bounding surface, each of said wedges being positionable in an upright position having each of said wedges extending upwardly from said bounding surface wherein said plurality of wedges is configured to restrain a paint can of a small diameter;

a plurality of panels, each of said panels having a first end, a second end, a front edge and a back edge, each of said front edge and said back edge being curved between said first end and said second end such that each of said panels forms a quadrant of a circle, said back edge of each of said panels being pivotally coupled to said bounding surface, each of said panels forming a ring encircling said plurality of wedges when said panels lie on said bounding surface, each of said panels being positionable in an upright position having each of said panels extending upwardly from said bounding surface wherein said plurality of panels is configured to restrain a paint can of a large diameter;

a lid being hingedly coupled to said case for opening and closing said case, said lid having a top wall and a perimeter wall extending downwardly therefrom, said perimeter wall having a rear side, said rear side being hingedly coupled to said back side of said outer wall of said case, said perimeter wall resting on said outer wall when said lid is closed;

a pair of supports, each of said supports comprising a first portion being pivotally coupled to a second portion, said first portion of each of said supports being movably coupled to said outer wall of said case, said second portion of each of said supports being movably coupled to said perimeter wall of said lid, each of said supports being biased into an extended position when said lid is positioned in said open position for releasably retaining said lid in said open position;

a pole being extendable through said case, said pole having an exposed portion when said pole is extended through said case wherein said exposed portion is configured to be inserted into a rung of a ladder thereby mounting said case to the ladder, said pole being insertable through each of said first openings in said outer wall of said case or each of said second openings in said outer wall of said case, said exposed portion of said pole extending away from said front side of said outer wall of said case;

a case member being coupled to and extending away from said case, said case member being attached to said bottom wall of said case, said case member extending away from said front side of said outer wall, said case member having a distal end with respect to said front side;

a grip being coupled to said case member, said grip extending around said pole when said pole is extended through said case wherein said grip is configured to extend around the rung through which said pole is extended, said grip comprising:

a grip member having a first end and a second end, said first end being pivotally coupled to said case member at a point located adjacent to said distal end of said case member, said grip member being pivotal on an axis being oriented perpendicular to a longitudinal axis of said case member, said grip being rotatable to point toward either said first hole or said second hole in said front side of said outer wall of said case; and a collar having a primary end and a secondary end, said collar being curved such that said primary end is spaced from said secondary end, said secondary end being coupled to said second end of said grip member wherein said collar is configured to extend around the rung through which said pole is extended thereby stabilizing said case on the rung, and a pair of storage units, each of said storage units being attachable to said lid when said lid is in an open position wherein each of said storage units is configured to facilitate tools stored in said storage units to be accessible to a user, each of said storage units comprising:

a bracket having a central portion extending between a first portion and a second portion such that said bracket has a "U" shape, said bracket being positionable over said lid when said lid is in an open position having said central portion resting on perimeter wall of said lid having each of said first portion and said second portion extending toward said case, said first portion having a distal end with respect to said central portion; and a box being coupled to said distal end of said first portion such that said box is suspended on said lid when said bracket is positioned on said lid, said box having a top end being open and being directed upwardly when said bracket is positioned on said lid wherein said box is configured to store tools.

* * * * *